US009213255B1

(12) United States Patent
Zaretsky et al.

(10) Patent No.: US 9,213,255 B1
(45) Date of Patent: Dec. 15, 2015

(54) PRINTING TACTILE IMAGES WITH IMPROVED IMAGE QUALITY

(71) Applicants: Mark Cameron Zaretsky, Rochester, NY (US); William Joseph Hagen, Hilton, NY (US)

(72) Inventors: Mark Cameron Zaretsky, Rochester, NY (US); William Joseph Hagen, Hilton, NY (US)

(73) Assignee: EASTMAN KODAK COMPANY, Rochester, NY (US)

( * ) Notice: Subject to any disclaimer, the term of this patent is extended or adjusted under 35 U.S.C. 154(b) by 0 days.

(21) Appl. No.: 14/469,993

(22) Filed: Aug. 27, 2014

(51) Int. Cl.
*G03G 15/01* (2006.01)
*G03G 15/08* (2006.01)
*G03G 15/22* (2006.01)

(52) U.S. Cl.
CPC ..... *G03G 15/08* (2013.01); *G03G 15/224* (2013.01)

(58) Field of Classification Search
CPC ..... G03G 15/224; G03G 2215/0103
USPC ..... 399/1, 223
See application file for complete search history.

(56) References Cited

U.S. PATENT DOCUMENTS

| | | | | |
|---|---|---|---|---|
| 4,459,344 | A | 7/1984 | Jacob | |
| 4,540,644 | A | 9/1985 | Jacob | |
| 5,794,111 | A | 8/1998 | Tombs et al. | |
| 5,968,656 | A | 10/1999 | Ezenyilimba et al. | |
| 6,993,269 | B2 | 1/2006 | Yamauchi et al. | |
| 7,212,772 | B2 | 5/2007 | Kasiske et al. | |
| 7,215,442 | B2 | 5/2007 | Yamauchi et al. | |
| 7,488,563 | B2 | 2/2009 | Rimai et al. | |
| 7,783,243 | B2 | 8/2010 | Cahill et al. | |
| 7,831,178 | B2 | 11/2010 | Priebe et al. | |
| 7,965,961 | B2 | 6/2011 | Priebe et al. | |
| 8,064,788 | B2 | 11/2011 | Zaretsky et al. | |
| 8,147,948 | B1 | 4/2012 | Tyagi et al. | |
| 8,320,784 | B2 | 11/2012 | Tombs et al. | |
| 8,358,957 | B2 | 1/2013 | Tombs et al. | |
| 8,383,315 | B2 | 2/2013 | Tyagi et al. | |
| 8,435,712 | B2 | 5/2013 | Tyagi et al. | |
| 8,465,899 | B2 | 6/2013 | Aslam et al. | |
| 8,475,926 | B2 | 7/2013 | Ferrar et al. | |
| 8,626,015 | B2 | 1/2014 | Aslam et al. | |
| 8,626,915 | B2 | 1/2014 | Uchida | |
| 2012/0202022 | A1* | 8/2012 | Schulze-Hagenest | 428/207 |
| 2013/0293657 | A1 | 11/2013 | Delmerico | |
| 2014/0119753 | A1 | 5/2014 | Zaretsky et al. | |

* cited by examiner

*Primary Examiner* — Sophia S Chen
(74) *Attorney, Agent, or Firm* — Kevin E. Spaulding

(57) ABSTRACT

A method of forming an electrophotographic image having raised information providing a distinct tactile feel. A layer of non-marking particles is formed onto a receiver medium using an electrophotographic process responsive to tactile image data. One or more layers of marking particles are then formed over the layer of non-marking particles responsive to visible image data, wherein a volume average diameter of the non-marking particles is between 150% and 200% of the volume average diameter of the marking particles. The formed layers of non-marking particles and marking particles are then fused onto the receiver medium, wherein the layer of fused non-marking particles has a maximum thickness of at least 20 μm to provide the distinct tactile feel.

5 Claims, 6 Drawing Sheets

PRINTING TACTILE IMAGES WITH IMPROVED IMAGE QUALITY

CROSS-REFERENCE TO RELATED APPLICATIONS

Reference is made to commonly assigned, co-pending U.S. patent application Ser. No. 14/470,028, entitled: "Printing improved tactile images using intermediate transfer member," by Zaretsky, which is incorporated herein by reference.

FIELD OF THE INVENTION

This invention relates in general to electrographic printing, and more particularly to a method for achieving higher image quality for selective printing of raised information providing a tactile feel using electrography.

BACKGROUND OF THE INVENTION

In electrophotographic printing systems, an electrostatic latent image is formed on a photoconductor and developed into a visible image by bringing the photoconductor into close proximity or contact with charged toner particles (also referred to in the art as marking particles). In a two-component developer, the toner particles becomes tribocharged and are attracted to the electrostatic latent image regions of the photoconductor.

After the electrostatic latent image on the photoconductor has been developed, the developed image is generally transferred to a receiver medium, such as a sheet of paper or transparency stock. This is typically accomplished by applying an electric field in such a manner to urge the toner particles from the photoconductor to the receiver medium.

In some configurations, it is preferable to first transfer the developed image from the photoconductor to an intermediate transfer member, and then from the intermediate transfer member to the receiver medium. Again, this is commonly accomplished by applying an electric field to urge the developed image toward the intermediate transfer member for the first transfer, and toward the receiver medium for the second transfer.

For multi-color images, the process of forming an electrostatic latent image and developing the image typically occurs in a plurality of separate electrophotographic modules, one for each color. The developed color separations are then either accumulated onto an intermediate transfer member or directly onto the receiver medium with multiple transfer steps, one for each color separation.

After the toner image has been transferred to the receiver medium, the receiver medium bearing the transferred toner image is then passed through a fusing device to permanently affix the developed image to the receiver medium by heat and pressure.

In the earlier days of electrographic printing, the marking particles were relatively large (e.g., on the order of 10-15 μm). As a result the print image had a tendency to exhibit a relief appearance (variably raised surface). Under most circumstances, the relief appearance was considered an objectionable artifact in the print image. In order to improve image quality, and to reduce relief appearance, over the years, smaller marking particles (e.g., on the order of less than 8 μm) have been formulated and are more commonly used today. This has the additional advantage of reducing image granularity.

With the improved print image quality, print providers and customers alike have been looking at ways to expand the use of electrographically produced prints. In certain classes of printing, a tactile feel to the print is considered to be highly desirable. Specifically, ultra-high quality printing such as for stationary headers, business cards, or greeting cards and invitations, utilize raised letter printing to give a tactile feel to the resultant print output. In the offset printing industry, this is typically carried out via thermography in an offline process. Some other applications where providing tactile feel in the printed image would be desirable are documents including Braille or other features adapted to be sensed by a visually-impaired person, or documents including tactile security features.

U.S. Pat. No. 7,783,243 to Cahill, et al., entitled "Enhanced fuser offset latitude method," and U.S. Pat. No. 8,358,957 to Tombs, et al., entitled "Selective printing of raised information by electrography," both disclose the electrophotographic production of printed images including raised tactile features using a larger-sized (e.g., 12-30 μm) clear (e.g., non-pigmented) toner applied together with small-sized (<9 μm) pigmented toners. U.S. Pat. No. 8,626,015 to Aslam, et al., entitled "Large particle toner printer," discloses a printer for printing images including raised tactile features using a smaller-sized (3 to 9 μm) toner applied together with a larger-sized (e.g., >20 μm) toner having a charge-to-mass ratio that is between ⅓ and ½ the charge-to-mass ratio of the smaller-sized toner. In all of these configurations, the smaller-sized pigmented toners are first to be deposited onto the receiver, and the larger-sized clear toner is last to be deposited onto the receiver and consequently fused atop the smaller-sized toner. This laydown order is advantageous for the electrostatic transfer process since it is difficult to efficiently transfer the smaller-sized toner on top of the larger-sized toner. For example, if the larger-sized clear toner was applied first, the maximum electric field achievable in the transfer nip of the downstream printing modules would be reduced to a much lower level due to the Paschen limit for the larger air gaps created by the larger-sized toner. However, it has been found that the resulting fused images suffer from color desaturation due to the thick layer of clear toner that is placed above the color toner. This limits the color gamut achievable for raised printing using these approaches.

U.S. Pat. No. 6,993,269 to Yamauchi, et al., entitled "Image forming apparatus, image processing apparatus, image forming method and image processing method for forming/processing a three-dimensional image," discloses the electrophotographic production of raised prints having the tactile effect produced by using a foamable toner in contact with the substrate. The disclosed electrophotographic apparatus utilizes an intermediate transfer process where multiple toner images (both color and clear) are accumulated on an intermediate transfer member and subsequently transferred as an integral mass of toner onto the substrate. The color and clear foamable toner are of similar size prior to fusing, as shown in the figures and inferred by the description of the printed image only becoming three dimensional after fusing. This approach has the additional disadvantage that making a foamable toner adds another level of complexity and cost to the toner formulation.

U.S. Pat. No. 4,459,344 to Jacob, entitled "Method for producing raised images by xerographic means," also discloses the use of foamable (i.e., thermally intumesced) toner to produce raised prints using an electrophotographic process. As stated above, the additional requirements of formulating a foamable toner are undesirable from a complexity and cost viewpoint.

There remains a need for a method to provide printed electrophotographic images having tactile features with excellent color saturation at a reasonable cost for both toner materials and machine hardware.

SUMMARY OF THE INVENTION

The present invention represents a method of forming an electrophotographic image on a receiver medium having raised information providing a distinct tactile feel, comprising:

forming a layer of non-marking particles onto the receiver medium using an electrophotographic process responsive to tactile image data, wherein the layer of non-marking particles is in direct contact with the receiver medium;

forming one or more layers of marking particles over the layer of non-marking particles using an electrophotographic process responsive to visible image data, wherein a volume average diameter of the non-marking particles is at least 150% of a volume average diameter of the marking particles and is no more than 200% of the volume average diameter of the marking particles; and fusing the formed layers of non-marking particles and marking particles onto the receiver medium, wherein the layer of fused non-marking particles has a maximum thickness of at least 20 μm to provide the distinct tactile feel.

This invention has the advantage that tactile images can be formed using an electrophotographic process without having a negative effect on the color saturation of the printed visible image due to the layers of marking particles being formed over the layer of non-marking particles.

It has the additional advantage that the relative sizes of the marking and non-marking particles are chosen so that the marking particles will substantially coalesce and fuse together in a layer above the non-marking particles, thereby minimizing the mixing of material between the layers marking particles and non-marking particles to further minimize any negative effect on the color saturation of the printed visible image.

BRIEF DESCRIPTION OF THE DRAWINGS

It is to be understood that the attached drawings are for purposes of illustrating the concepts of the invention and may not be to scale. Identical reference numerals have been used, where possible, to designate identical features that are common to the figures.

DETAILED DESCRIPTION OF THE INVENTION

Figure 1:
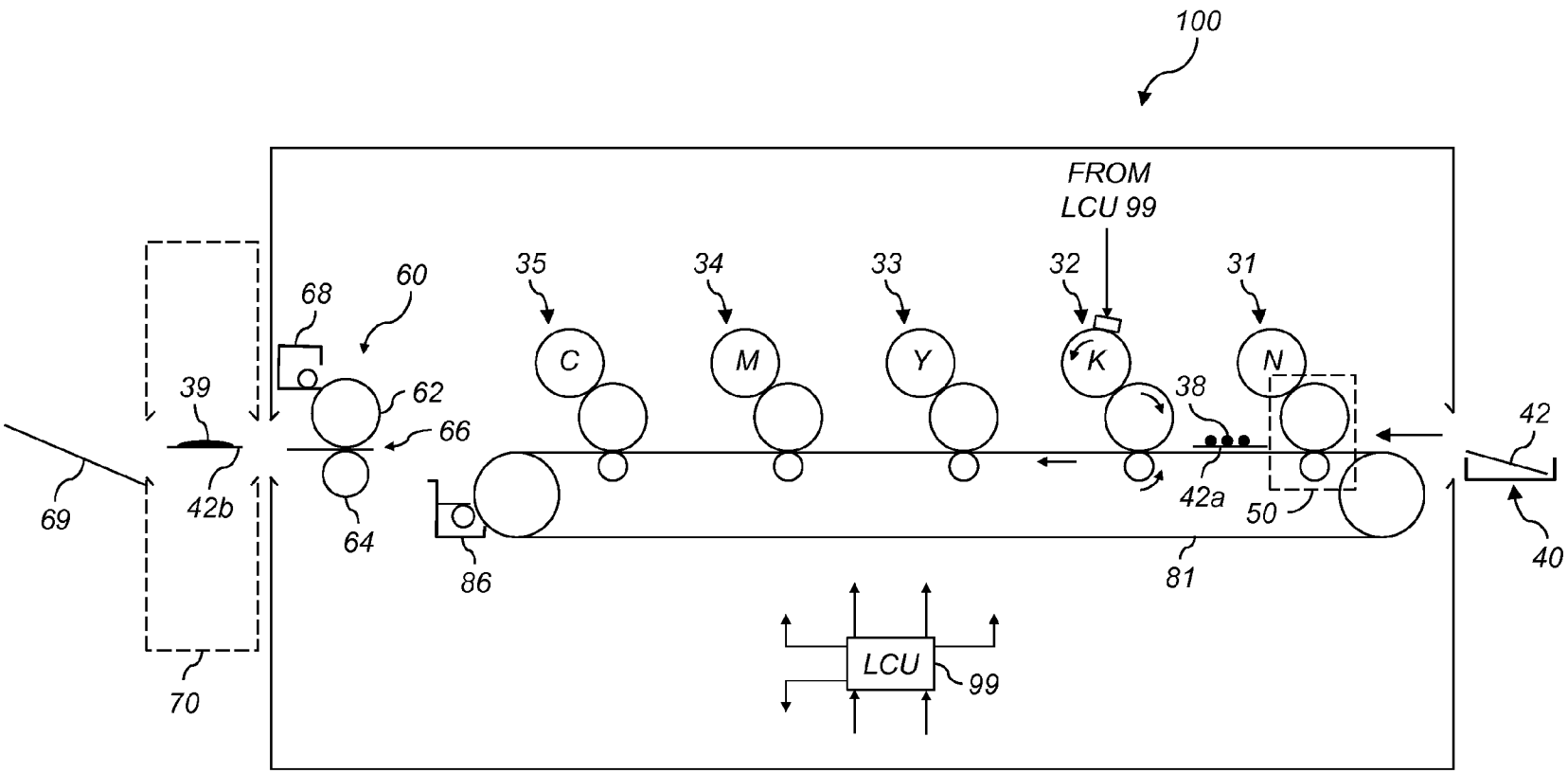
FIG. 1 is an elevational cross-section of an electrophotographic printer suitable for use with various embodiments.

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated, or as are readily apparent to one of skill in the art. The use of singular or plural in referring to the "method" or "methods" and the like is not limiting. It should be noted that, unless otherwise explicitly noted or required by context, the word "or" is used in this disclosure in a non-exclusive sense.

As used herein, the terms "parallel" and "perpendicular" have a tolerance of ±10°.

As used herein, "sheet" is a discrete piece of media, such as receiver media for an electrophotographic printer (described below). Sheets have a length and a width. Sheets are folded along fold axes (e.g., positioned in the center of the sheet in the length dimension, and extending the full width of the sheet). The folded sheet contains two "leaves," each leaf being that portion of the sheet on one side of the fold axis. The two sides of each leaf are referred to as "pages." "Face" refers to one side of the sheet, whether before or after folding.

As used herein, "toner particles" are particles of one or more material(s) that are transferred by an electrophotographic (EP) printer to a receiver to produce a desired effect or structure (e.g., a print image, texture, pattern, or coating) on the receiver. Toner particles can be ground from larger solids, or chemically prepared (e.g., precipitated from a solution of a pigment and a dispersant using an organic solvent), as is known in the art. Toner particles can have a range of diameters (e.g., less than 8 μm, on the order of 10-15 μm, up to approximately 30 μm, or larger), where "diameter" preferably refers to the volume-weighted median diameter, as determined by a device such as a Coulter Multisizer. When practicing this invention, it is preferable to use larger toner particles (i.e., those having diameters of at least 11 μm) in order to obtain the desirable toner stack heights that would enable macroscopic toner relief structures to be formed.

"Toner" refers to a material or mixture that contains toner particles, and that can be used to form an image, pattern, or coating when deposited on an imaging member including a photoreceptor, a photoconductor, or an electrostatically-charged or magnetic surface. Toner can be transferred from the imaging member to a receiver. Toner is also referred to in the art as marking particles, dry ink, or developer, but note that herein "developer" is used differently, as described below. Toner can be a dry mixture of particles or a suspension of particles in a liquid toner base.

As mentioned already, toner includes toner particles; it can also include other types of particles. The particles in toner can be of various types and have various properties. Such properties can include absorption of incident electromagnetic radiation (e.g., particles containing colorants such as dyes or pigments), absorption of moisture or gasses (e.g., desiccants or getters), suppression of bacterial growth (e.g., biocides, particularly useful in liquid-toner systems), adhesion to the receiver (e.g., binders), electrical or thermal conductivity or low magnetic reluctance (e.g., metal particles), texture, gloss, magnetic remanence, florescence, resistance to etchants, and other properties of additives known in the art.

In single-component or mono-component development systems, "developer" refers to toner alone. In these systems, none, some, or all of the particles in the toner can themselves be magnetic. However, developer in a mono-component system does not include magnetic carrier particles. In dual-component, two-component, or multi-component development systems, "developer" refers to a mixture including toner particles and magnetic carrier particles, which can be electrically-conductive or -non-conductive. Toner particles can be magnetic or non-magnetic. The carrier particles can be larger than the toner particles (e.g., 15-20 μm or 20-300 μm in diameter). A magnetic field is used to move the developer in these systems by exerting a force on the magnetic carrier particles. The developer is moved into proximity with an imaging member or transfer member by the magnetic field, and the toner or toner particles in the developer are transferred from the developer to the member by an electric field, as will be described further below. The magnetic carrier particles are not intentionally deposited on the member by action of the electric field; only the toner is intentionally deposited. However, magnetic carrier particles, and other particles in the toner or developer, can be unintentionally transferred to an imaging member. Developer can include other additives known in the art, such as those listed above for toner. Toner and carrier particles can be substantially spherical or non-spherical.

The electrophotographic process can be embodied in devices including printers, copiers, scanners, and facsimiles, and analog or digital devices, all of which are referred to herein as "printers." Various embodiments described herein are useful with electrostatographic printers such as electrophotographic printers that employ toner developed on an electrophotographic receiver, and ionographic printers and copiers that do not rely upon an electrophotographic receiver. Electrophotography and ionography are types of electrostatography (printing using electrostatic fields), which is a subset of electrography (printing using electric fields). The present invention can be practiced using any type of electrographic printing system, including electrophotographic and ionographic printers.

A digital reproduction printing system ("printer") typically includes a digital front-end processor (DFE), a print engine (also referred to in the art as a "marking engine") for applying toner to the receiver, and one or more post-printing finishing system(s) (e.g., a UV coating system, a glosser system, or a laminator system). A printer can reproduce pleasing black-and-white or color images onto a receiver. A printer can also produce selected patterns of toner on a receiver, which patterns (e.g., surface textures) do not correspond directly to a visible image.

The DFE receives input electronic files (such as Postscript command files) composed of images from other input devices (e.g., a scanner, a digital camera or a computer-generated image processor). Within the context of the present invention, images can include photographic renditions of scenes, as well as other types of visual content such as text or graphical elements. Images can also include invisible content such as specifications of texture, gloss or protective coating patterns.

The DFE can include various function processors, such as a raster image processor (RIP), image positioning processor, image manipulation processor, color processor, or image storage processor. The DFE rasterizes input electronic files into image bitmaps for the print engine to print. In some embodiments, the DFE permits a human operator to set up parameters such as layout, font, color, paper type, or post-finishing options. The print engine takes the rasterized image bitmap from the DFE and renders the bitmap into a form that can control the printing process from the exposure device to transferring the print image onto the receiver. The finishing system applies features such as protection, glossing, or binding to the prints. The finishing system can be implemented as an integral component of a printer, or as a separate machine through which prints are fed after they are printed.

The printer can also include a color management system that accounts for characteristics of the image printing process implemented in the print engine (e.g., the electrophotographic process) to provide known, consistent color reproduction characteristics. The color management system can also provide known color reproduction for different inputs (e.g., digital camera images or film images). Color management systems are well-known in the art, and any such system can be used to provide color corrections in accordance with the present invention.

In an embodiment of an electrophotographic modular printing machine useful with various embodiments (e.g., the NEXPRESS 2100 printer manufactured by Eastman Kodak Company of Rochester, N.Y.) color-toner print images are made in a plurality of color imaging modules arranged in tandem, and the print images are successively electrostatically transferred to a receiver adhered to a transport web moving through the modules. Colored toners include colorants, (e.g., dyes or pigments) which absorb specific wavelengths of visible light. Commercial machines of this type typically employ intermediate transfer members in the respective modules for transferring visible images from the photoreceptor and transferring print images to the receiver. In other electrophotographic printers, each visible image is directly transferred to a receiver to form the corresponding print image.

Electrophotographic printers having the capability to also deposit clear toner using an additional imaging module are also known. The provision of a clear-toner overcoat to a color print is desirable for providing features such as protecting the print from fingerprints, reducing certain visual artifacts or providing desired texture or surface finish characteristics. Clear toner uses particles that are similar to the toner particles of the color development stations but without colored material (e.g., dye or pigment) incorporated into the toner particles. However, a clear-toner overcoat can add cost and reduce color gamut of the print; thus, it is desirable to provide for operator/user selection to determine whether or not a clear-toner overcoat will be applied to the entire print. A uniform layer of clear toner can be provided. A layer that varies inversely according to heights of the toner stacks can also be used to establish level toner stack heights. The respective color toners are deposited one upon the other at respective locations on the receiver and the height of a respective color toner stack is the sum of the toner heights of each respective color. Uniform stack height provides the print with a more even or uniform gloss.

Figure 2:
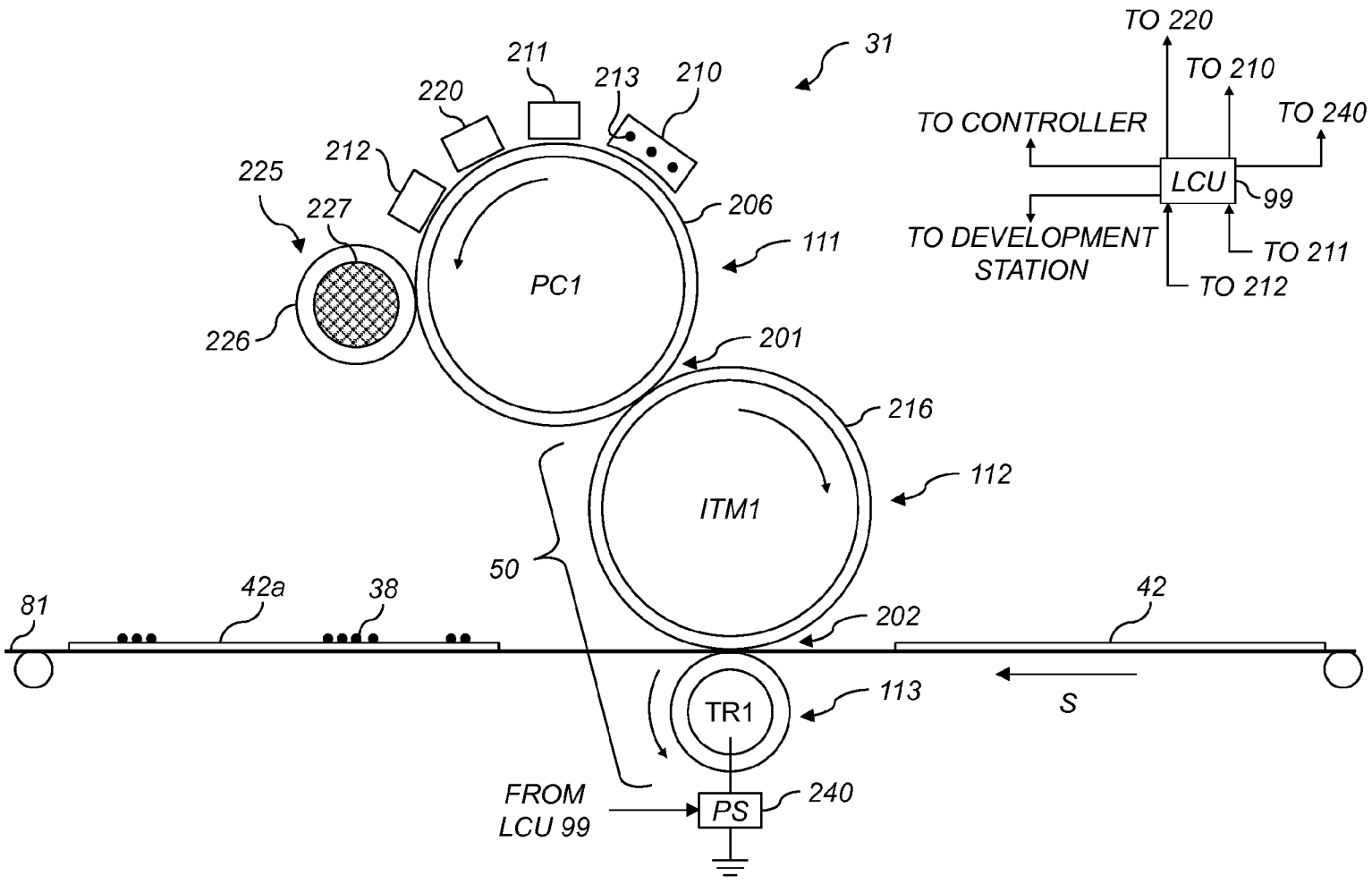
FIG. 2 is an elevational cross-section of one printing module of the electrophotographic printer of FIG. 1.

FIGS. 1-2 are elevational cross-sections showing portions of a typical electrophotographic printer 100 useful with various embodiments. Printer 100 is adapted to produce images, such as single-color images (i.e., monochrome images), or multicolor images such as CMYK, or pentachrome (five-color) images, on a receiver. Multicolor images are also known as "multi-component" images. One embodiment involves printing using an electrophotographic print engine having five sets of single-color image-producing or image-printing stations or modules arranged in tandem, but more or less than five colors can be combined on a single receiver. Other electrophotographic writers or printer apparatus can also be included. Various components of printer 100 are shown as rollers; other configurations are also possible, including belts.

Referring to FIG. 1, printer 100 is an electrophotographic printing apparatus having a number of tandemly-arranged electrophotographic image-forming printing modules 31, 32, 33, 34, 35, also known as electrophotographic imaging subsystems. Each printing module 31, 32, 33, 34, 35 produces a single-color toner image for transfer using a respective transfer subsystem 50 (for clarity, only one is labeled) to a receiver 42 successively moved through the modules. In some embodiments one or more of the printing module 31, 32, 33, 34, 35 can print a colorless toner image, which can be used to provide a protective overcoat or tactile image features. Receiver 42 is transported from supply unit 40, which can include active feeding subsystems as known in the art, into printer 100 using a transport web 81. In various embodiments, the visible image can be transferred directly from an imaging roller to a receiver, or from an imaging roller to one or more transfer roller(s) or belt(s) in sequence in transfer subsystem 50, and then to receiver 42. Receiver 42 is, for example, a selected section of a web or a cut sheet of a planar receiver media such as paper or transparency film.

In the illustrated embodiments, each receiver 42 can have up to five single-color toner images transferred in registration thereon during a single pass through the five printing modules 31, 32, 33, 34, 35 to form a pentachrome image. As used herein, the term "pentachrome" implies that in a print image, combinations of various of the five colors are combined to form other colors on the receiver at various locations on the receiver, and that all five colors participate to form process colors in at least some of the subsets. That is, each of the five colors of toner can be combined with toner of one or more of the other colors at a particular location on the receiver to form a color different than the colors of the toners combined at that location. In an exemplary embodiment, printing module 31 forms clear "non-marking" (N) print images, printing module 32 forms black (K) print images, printing module 33 forms yellow (Y) print images, printing module 34 forms magenta (M) print images, and printing module 35 forms cyan (C) print images. Within the context of the present disclosure, the term "non-marking particles" will be used to refer to the clear non-pigmented toner particles used to print the clear non-marking print image, and the term "marking particles" will be used to refer to the visible toner particles used to print the visible print images (e.g., the CMYK print images).

The four subtractive primary colors, cyan, magenta, yellow, and black, can be combined in various combinations of subsets thereof to form a representative spectrum of colors. The color gamut of a printer (i.e., the range of colors that can be produced by the printer) is dependent upon the materials used and the process used for forming the colors. Additional colors can therefore be added to improve the color gamut. For example, in some embodiments, additional printing modules can be used to print additional colors such as red, green or blue to provide a larger color gamut. Additional colors can also be added to provide a specialty color or spot color, such as for making proprietary logos or colors that cannot be produced with only CMYK colors (e.g., metallic, fluorescent, or pearlescent colors).

Receiver 42*a* is shown after passing through printing module 31. Print image 38 on receiver 42*a* includes unfused toner particles. Subsequent to transfer of the respective print images, overlaid in registration, one from each of the respective printing modules 31, 32, 33, 34, 35, receiver 42*a* is advanced to a fuser module 60 (i.e., a fusing or fixing assembly) to fuse the print image 38 to the receiver 42*a*. Transport web 81 transports the print-image-carrying receivers to the fuser module 60, which fixes the toner particles to the respective receivers, generally by the application of heat and pressure. The receivers are serially de-tacked from the transport web 81 to permit them to feed cleanly into the fuser module 60. The transport web 81 is then reconditioned for reuse at cleaning station 86 by cleaning and neutralizing the charges on the opposed surfaces of the transport web 81. A mechanical cleaning station (not shown) for scraping or vacuuming toner off transport web 81 can also be used independently or with cleaning station 86. The mechanical cleaning station can be disposed along the transport web 81 before or after cleaning station 86 in the direction of rotation of transport web 81.

In the illustrated embodiment, the fuser module 60 includes a heated fusing roller 62 and an opposing pressure roller 64 that form a fusing nip 66 therebetween. In an embodiment, fuser module 60 also includes a release fluid application substation 68 that applies release fluid, e.g., silicone oil, to fusing roller 62. Alternatively, wax-containing toner can be used without applying release fluid to the fusing roller 62. Other embodiments of fusers, both contact and non-contact, can be employed. For example, solvent fixing uses solvents to soften the toner particles so they bond with the receiver. Photoflash fusing uses short bursts of high-frequency electromagnetic radiation (e.g., ultraviolet light) to melt the toner. Radiant fixing uses lower-frequency electromagnetic radiation (e.g., infrared light) to more slowly melt the toner. Microwave fixing uses electromagnetic radiation in the microwave range to heat the receivers (primarily), thereby causing the toner particles to melt by heat conduction, so that the toner is fixed to the receiver.

The fused receivers (e.g., receiver 42*b* carrying fused image 39) are transported in series from the fuser module 60 along a path either to an output tray 69, or back to printing modules 31, 32, 33, 34, 35 to form an image on the backside of the receiver (i.e., to form a duplex print). Receivers 42*b* can also be transported to any suitable output accessory. For example, an auxiliary fuser or glossing assembly can provide a clear-toner overcoat. Printer 100 can also include multiple fuser modules 60 to support applications such as overprinting, as known in the art.

In various embodiments, between the fuser module 60 and the output tray 69, receiver 42*b* passes through a finisher 70. Finisher 70 performs various paper-handling operations, such as folding, stapling, saddle-stitching, collating, and binding.

Printer 100 includes main printer apparatus logic and control unit (LCU) 99, which receives input signals from various sensors associated with printer 100 and sends control signals to various components of printer 100. LCU 99 can include a microprocessor incorporating suitable look-up tables and control software executable by the LCU 99. It can also include a field-programmable gate array (FPGA), programmable logic device (PLD), programmable logic controller (PLC) (with a program in, e.g., ladder logic), microcontroller, or other digital control system. LCU 99 can include memory for storing control software and data. In some embodiments, sensors associated with the fuser module 60 provide appropriate signals to the LCU 99. In response to the sensor signals, the LCU 99 issues command and control signals that adjust the heat or pressure within fusing nip 66 and other operating parameters of fuser module 60. This permits printer 100 to print on receivers of various thicknesses and surface finishes, such as glossy or matte.

Image data for printing by printer 100 can be processed by a raster image processor (RIP; not shown), which can include a color separation screen generator or generators. The output of the RIP can be stored in frame or line buffers for transmission of the color separation print data to each of a set of respective LED writers associated with the printing modules 31, 32, 33, 34, 35 (e.g., for clear (N), black (K), yellow (Y), magenta (M) and cyan (C), respectively). The RIP or color separation screen generator can be a part of printer 100 or remote therefrom. Image data processed by the RIP can be obtained from a color document scanner or a digital camera or produced by a computer or from a memory or network which typically includes image data representing a continuous image that needs to be reprocessed into halftone image data in order to be adequately represented by the printer. The RIP can perform image processing processes (e.g., color correction) in order to obtain the desired color print. Color image data is separated into the respective colors and converted by the RIP to halftone dot image data in the respective color (for example, using halftone matrices, which provide desired screen angles and screen rulings). The RIP can be a suitably-programmed computer or logic device and is adapted to employ stored or computed halftone matrices and templates for processing separated color image data into rendered image data in the form of halftone information suitable for printing. These halftone matrices can be stored in a screen pattern memory.

FIG. 2 shows additional details of printing module 31, which is representative of printing modules 32, 33, 34, and 35 (FIG. 1). Photoreceptor 206 of imaging member 111 includes a photoconductive layer formed on an electrically conductive substrate. The photoconductive layer is an insulator in the substantial absence of light so that electric charges are retained on its surface. Upon exposure to light, the charge is dissipated. In various embodiments, photoreceptor 206 is part of, or disposed over, the surface of imaging member 111, which can be a plate, drum, or belt. Photoreceptors 206 can include a homogeneous layer of a single material such as vitreous selenium or a composite layer containing a photoconductor and another material. Photoreceptors 206 can also contain multiple layers.

Charging subsystem 210 applies a uniform electrostatic charge to photoreceptor 206 of imaging member 111. In an exemplary embodiment, charging subsystem 210 includes a wire grid 213 having a selected voltage. Additional necessary components provided for control can be assembled about the various process elements of the respective printing modules. Meter 211 measures the uniform electrostatic charge provided by charging subsystem 210.

An exposure subsystem 220 is provided for selectively modulating the uniform electrostatic charge on photoreceptor 206 in an image-wise fashion by exposing photoreceptor 206 to electromagnetic radiation to form a latent electrostatic image. The uniformly-charged photoreceptor 206 is typically exposed to actinic radiation provided by selectively activating particular light sources in an LED array or a laser device outputting light directed onto photoreceptor 206. In embodiments using laser devices, a rotating polygon (not shown) is sometimes used to scan one or more laser beam(s) across the photoreceptor 206 in the fast-scan direction. One pixel site is exposed at a time, and the intensity or duty cycle of the laser beam is varied at each dot site. In embodiments using an LED array, the array can include a plurality of LEDs arranged next to each other in a line, all dot sites in one row of dot sites on the photoreceptor 206 can be selectively exposed simultaneously, and the intensity or duty cycle of each LED can be varied within a line exposure time to expose each pixel site in the row during that line exposure time.

As used herein, an "engine pixel" is the smallest addressable unit on photoreceptor 206 which the exposure subsystem 220 (e.g., the laser or the LED) can expose with a selected exposure different from the exposure of another engine pixel. Engine pixels can overlap (e.g., to increase addressability in the slow-scan direction). Each engine pixel has a corresponding engine pixel location, and the exposure applied to the engine pixel location is described by an engine pixel level.

The exposure subsystem 220 can be a write-white or write-black system. In a write-white or "charged-area-development" system, the exposure dissipates charge on areas of photoreceptor 206 to which toner should not adhere. Toner particles are charged to be attracted to the charge remaining on photoreceptor 206. The exposed areas therefore correspond to white areas of a printed page. In a write-black or "discharged-area development" system, the toner is charged to be attracted to a bias voltage applied to photoreceptor 206 and repelled from the charge on photoreceptor 206. Therefore, toner adheres to areas where the charge on photoreceptor 206 has been dissipated by exposure. The exposed areas therefore correspond to black areas of a printed page.

In the illustrated embodiment, meter 212 is provided to measure the post-exposure surface potential within a patch area of a latent image formed from time to time in a non-image area on photoreceptor 206. Other meters and components can also be included (not shown).

A development station 225 includes toning shell 226, which can be rotating or stationary, for applying toner of a selected color to the latent image on photoreceptor 206 to produce a developed image on photoreceptor 206 corresponding to the color of toner deposited at this printing module 31. Development station 225 is electrically biased by a suitable respective voltage to develop the respective latent image, which voltage can be supplied by a power supply (not shown). Developer is provided to toning shell 226 by a supply system (not shown) such as a supply roller, auger, or belt. Toner is transferred by electrostatic forces from development station 225 to photoreceptor 206. These forces can include Coulombic forces between charged toner particles and the charged electrostatic latent image, and Lorentz forces on the charged toner particles due to the electric field produced by the bias voltages.

In some embodiments, the development station 225 employs a two-component developer that includes toner particles and magnetic carrier particles. The exemplary development station 225 includes a magnetic core 227 to cause the magnetic carrier particles near toning shell 226 to form a "magnetic brush," as known in the electrophotographic art. Magnetic core 227 can be stationary or rotating, and can rotate with a speed and direction the same as or different than the speed and direction of toning shell 226. Magnetic core 227 can be cylindrical or non-cylindrical, and can include a single magnet or a plurality of magnets or magnetic poles disposed around the circumference of magnetic core 227. Alternatively, magnetic core 227 can include an array of solenoids driven to provide a magnetic field of alternating direction. Magnetic core 227 preferably provides a magnetic field of varying magnitude and direction around the outer circumference of toning shell 226. Development station 225 can also employ a mono-component developer comprising toner, either magnetic or non-magnetic, without separate magnetic carrier particles.

Transfer subsystem 50 includes transfer backup member (TR1) 113, and intermediate transfer member (ITM1) 112 for transferring the respective print image from photoreceptor 206 of imaging member (PC1) 111 through a first transfer nip 201 to surface 216 of intermediate transfer member 112, and thence to a receiver 42 which receives respective toned print images 38 from each printing module in superposition to form a composite image thereon. The print image 38 is, for example, a separation of one color, such as cyan. Receiver 42 is transported by transport web 81. Transfer to a receiver is effected by an electrical field provided to transfer backup member 113 by power source (PS) 240, which is controlled by LCU 99. Receiver 42 can be any object or surface onto which toner can be transferred from imaging member 111 by application of the electric field. In this example, receiver 42 is shown prior to entry into a second transfer nip 202, and receiver 42*a* is shown subsequent to transfer of the print image 38 onto receiver 42*a*.

In the illustrated embodiment, the toner image is transferred from the photoreceptor 206 to the intermediate transfer member 112, and from there to the receiver 42. Registration of the separate toner images is achieved by registering the separate toner images on the receiver 42, as is done with the NexPress 2100. In some embodiments, a single transfer member is used to sequentially transfer toner images from each color channel to the receiver 42. In other embodiments, the separate toner images can be transferred in register directly from the photoreceptor 206 in the respective printing module 31, 32, 33, 34, 35 to the receiver 42 without using a transfer member. Either transfer process is suitable when practicing this invention. An alternative method of transferring toner images involves transferring the separate toner images, in register, to a transfer member and then transferring the registered image to a receiver 42.

LCU 99 sends control signals to the charging subsystem 210, the exposure subsystem 220, and the respective development station 225 of each printing module 31, 32, 33, 34, 35 (FIG. 1), among other components. Each printing module can also have its own respective controller (not shown) coupled to LCU 99.

In the prior art it has been shown that it is desirable to use larger sized non-marking particles to provide a tactile feel. The total mass laydown of both non-marking and marking particles contribute to the raised print height. The mass laydown is defined as the mass per unit area which, for a fused toner stack, equals the product of the fused toner mass density and the height of the fused toner. For a desired height of 20 μm, and using a fused toner mass density of roughly 1.2 $g/cm^3$, the required mass laydown is 2.4 $mg/cm^2$. The change in toner stack height when going from an unfused to a fused condition generally results in a factor of 2 reduction in toner stack height. For example, a 40 μm unfused toner stack height will typically provide a 20 μm fused toner stack height. The larger the non-marking particles, the fewer the number of particles will be needed to provide this stack height. It is desirable to minimize this required number of particles so as to minimize the task of electrostatically depositing these particles onto a photoreceptor having a latent electrostatic image.

It is also well known in the prior art that the use of smaller sized marking particles (e.g., in the range of 4 to 9 μm volume average diameter, or even smaller) is desirable for higher image quality reproduction, resulting in images with lower grain, higher sharpness and improved tone scale.

The order of lay down of the marking particles and non-marking particles on the receiver 42 can greatly affect both transfer performance and image quality. Consider a printing process in which the marking particles (for providing one or more color separations) and non-marking particles (for providing the tactile feel) are deposited onto the receiver 42 in sequential steps. Inventors have determined that to provide the best color saturation, it is desirable to first deposit the non-marking particles onto the receiver 42 and then to deposit the marking particles on top of the non-marking particles. In this way, incident light on the printed image will be primarily reflected or absorbed by the uppermost layers of marking particles without being adversely affected (reflected, scattered, or absorbed) by the non-marking particles.

Prior art embodiments have used the opposite order in which the non-marking particles were the last ones to be deposited onto the receiver 42, with the marking particles being deposited underneath the non-marking particles. One advantage associated with the prior art laydown order lies in the fact that it is easier to deposit (electrostatically transfer) across smaller air gaps or onto smaller-sized toner stacks as created by the smaller-sized marking particles, as opposed to depositing the smaller-sized marking particles onto the larger-sized non-marking particles. However, as mentioned above, this results in a loss of color saturation when the incident light first encounters the non-marking particles.

Now consider a printing process in which the marking particles (for providing one or more color separations) and non-marking particles (for providing the tactile feel) are first deposited onto an intermediate transfer member in sequential steps and subsequently transferred all at once onto the receiver 42. In this case, the particles deposited last onto the intermediate transfer member will be the first particles on the receiver 42, and the particles deposited first onto the intermediate transfer member will be the last particles on the receiver 42. In this case, for the best color saturation, it is desirable to first deposit the marking particles onto the intermediate transfer member and then deposit the non-marking particles onto the intermediate transfer member. Finally, in a single transfer step, the layers of marking particles and non-marking particles are transferred onto the receiver 42 such that the marking particles are on top of the non-marking particles. As before, incident light on the printed image will be primarily reflected or absorbed by the uppermost layers of marking particles without being adversely affected (reflected, scattered, or absorbed) by the non-marking particles.

It has been described that it is desirable to provide tactile feel using a minimal number of non-marking particles, therefore it is desirable to use as large a non-marking particles as feasible. It has also been described that it is desirable to use smaller-sized marking particles to provide higher image quality. Finally, it has been described that it is desirable to deposit the non-marking particles directly onto the receiver 42, and then deposit the marking particles on top of the non-marking particles, so as to improve the color saturation of the printed image. However, a problem arises when fusing a toned receiver 42 having smaller-sized marking particles on top of larger-sized non-marking particles. As the toner begins to melt and flow, the smaller-sized marking particles begin to flow into the voids of the larger-sized non-marking particles, rather than coalescing with the other marking particles. This can result in a greatly reduced color density and saturation. Inventors have discovered that this problem can be largely mitigated by properly selecting the relative sizes of the marking particles and the non-marking particles.

It is well known that the permeability of a packed bed of particles increases with the square of the particle diameter. For spherical particles, the well-known Carman-Kozeny model predicts that:

$$K = \frac{\varepsilon^3}{36k(1-\varepsilon)^2} d^2 \tag{1}$$

where K is the permeability ($m^2$), $\epsilon$ is the porosity (dimensionless), d is the particle diameter (m) and K is the Kozeny-Carman constant, which is equal to 5 for beds of packed spherical particles.

Reducing the non-marking particle diameter will reduce the permeability and therefore the size of the voids, resulting in a reduction or elimination of the deleterious melt flow of the marking particles into the voids as described above. As an example, when using a 6 μm diameter marking particle, it was determined that a reduction in the diameter of the non-marking particles from 21 μm to 11 μm substantially eliminated this melt flow problem, resulting in excellent color saturation. Inventors have determined that it is desirable to choose the relative particle sizes so that a ratio of the volume average diameter of the non-marking particles to the volume average diameter of the marking particles is in the range of 150% to 200%, and more preferably is in the range of 160% to 190%.

Figure 3:
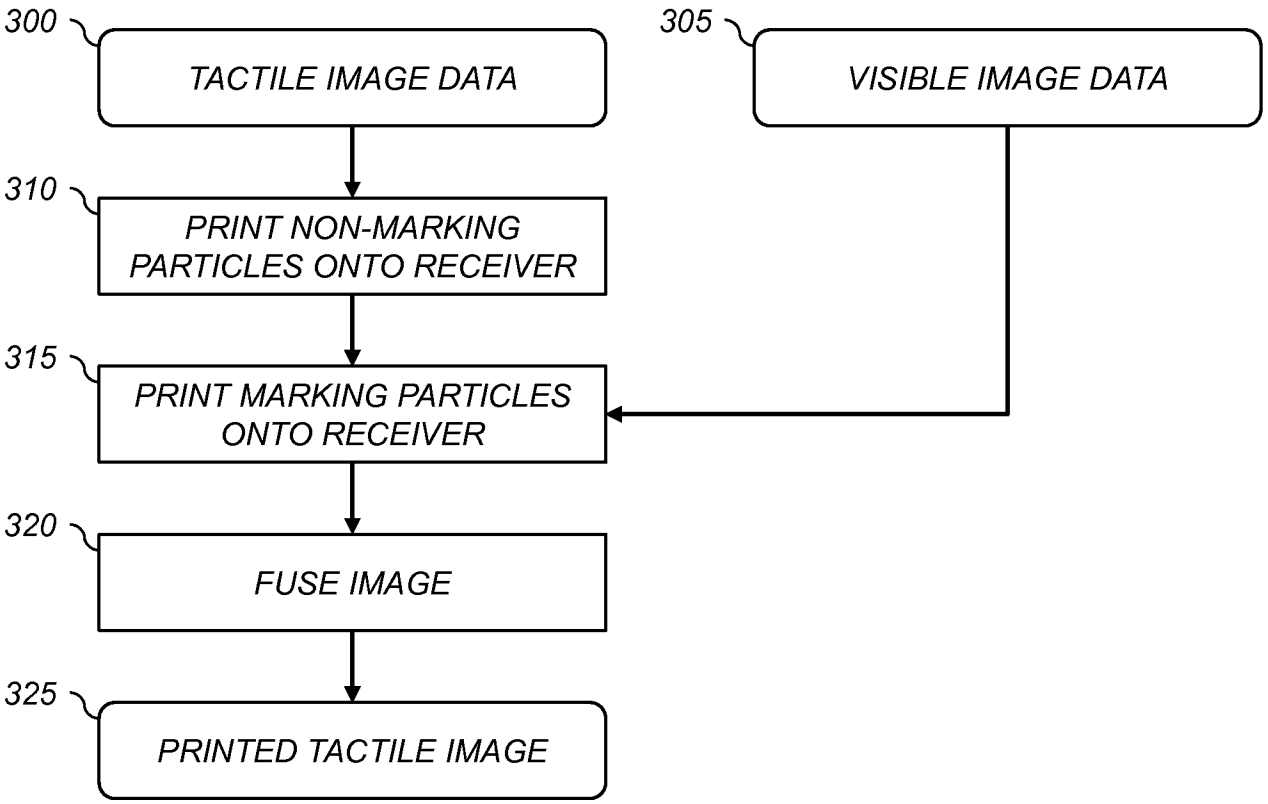
FIG. 3 is a flowchart of a method for producing a printed tactile image according to an exemplary embodiment.

FIG. 3 illustrates a flow chart of a method for forming printed images having a distinct tactile feel in accordance with an exemplary embodiment of the invention. The input to the method is tactile image data 300 defining a pattern of raised information to be printed together with visible image data 305 defining a conventional visible image.

In an exemplary embodiment the tactile image data 300 is represented by an array of pixel values encoding a desired height of the raised information as a function of position within the image. In some embodiments the pixel values can be binary values indicating whether or not raised information should be printed at a particular position. In other embodiments, the pixel values can be integer values (e.g., 8-bit integers ranging from 0 to 255) representing a range of different heights of the raised information. Typically, the visible image data 305 will be represented as array of pixel values encoding color information for a plurality of different color channels (e.g., CMYK).

The tactile image data 300 can be used to represent a variety of different kinds of tactile image content. For example, the tactile image data 300 can include Braille characters that can be sensed by visually-impaired persons. The tactile image data 300 can also be used to provide various other kinds of tactile patterns for communicating information to visually-impaired persons, such as the tactile patterns that are described in commonly-assigned, U.S. Patent Application Publication 2013/0293657 to Delmerico, entitled "Printed image for visually-impaired person," which is incorporated herein by reference. Such tactile patterns are generally made up of patterns of individual texture features such as small dots and lines, each of which can be provided in accordance with the present invention. The tactile image data 300 can also be used to provide surface textures that serve other purposes besides communicating information to visually-impaired persons, such as for creating various aesthetic effects such as controlling surface gloss.

A print non-marking particles onto receiver step 310 is used to form a pattern of non-marking particles (i.e., non-pigmented toner particles) on a surface of a receiver medium using an electrophotographic process responsive to the tactile image data 300. The non-marking particles are formed in a layer which is applied in direct contact with the receiver medium. In an exemplary embodiment, the layer of non-marking particles is applied by the first printing module 31 of the printer 100 (FIG. 1). Preferably, the non-marking particles do not contain any pigment so that they will be substantially colorless or transparent after they have been fused to the receiver medium.

Next, a print marking particles onto receiver step 315 is used to form a pattern of visible marking particles (i.e., pigmented toner particles) on the surface of the receiver medium using an electrophotographic process responsive to the visible image data 305. The marking particles are formed in one or more layers which are applied over the previously printed layer of non-marking particles. In an exemplary embodiment, each layer of marking particles has a different color and is applied by a corresponding printing module 32, 33, 34, 35 of the printer 100 (FIG. 1).

After the non-marking particles and the marking particles have been formed onto the receiver medium, a fuse image step 320 is used to fuse the image, permanently affixing the toner particles to the receiver medium, thereby forming printed tactile image 325. In an exemplary embodiment, the toner particles are fused using the fuser module 60 of printer 100 (FIG. 1).

Figure 4:
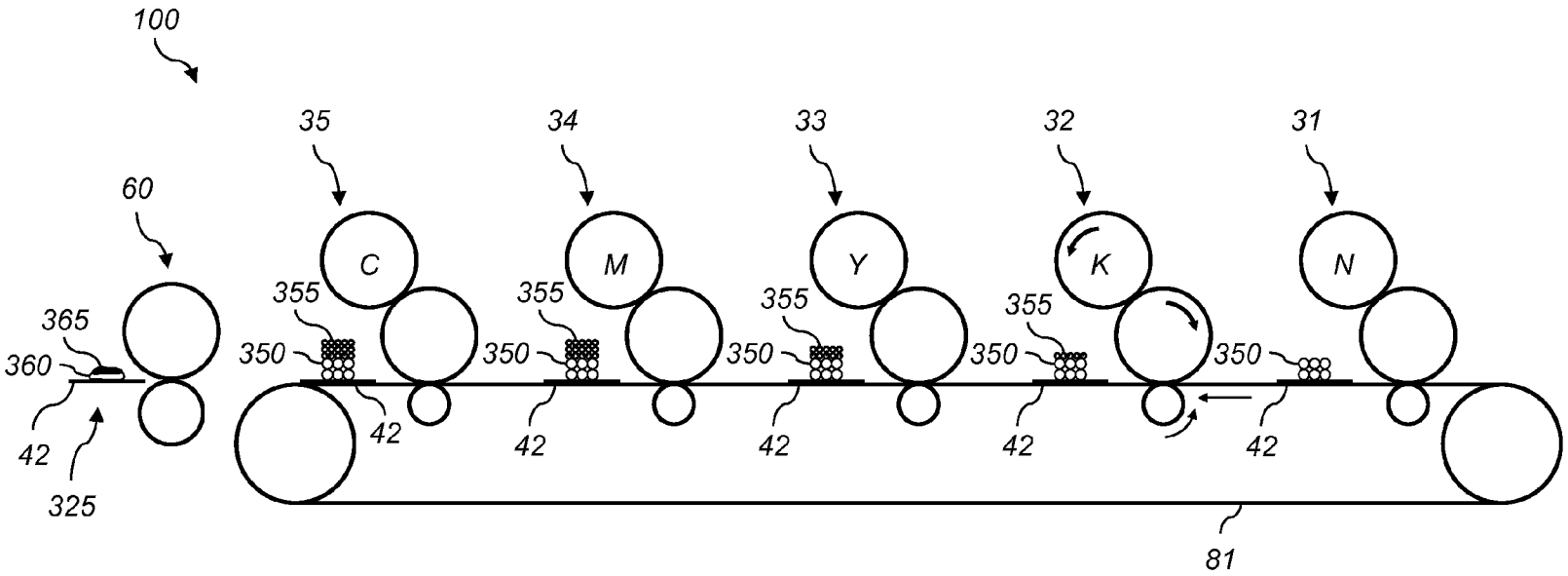
FIG. 4 is a schematic illustrating the formation of printed tactile images using the electrophotographic printer of FIG. 1.

FIG. 4 shows a portion of the printer 100 from FIG. 1 being used to form a printed image having a distinct tactile feel according to the method of FIG. 3. The first printing module 31 is used to form a layer of non-marking particles 350 onto the receiver medium 42. (Note that the size of the non-marking particles 350 has been highly exaggerated in this figure for clarity.) The layer of non-marking particles 350 is patterned according to tactile image data which defines a pattern of raised information to be formed on the printed image. Since the non-marking particles 350 are printed by the first printing module 31, they will be in direct contact with the receiver medium 42.

It should be noted that the "layer" of non-marking particles 350 is not limited to a single thickness of toner particles, and in fact will generally be substantially thicker than a single particle. Preferably, the layer of non-marking particles 350 is thick enough such that after the printed image is fused the resulting layer of fused non-marking particles 360 will have a maximum thickness of at least 20 μm in the most highly raised portions of the final printed tactile image 325 to provide the distinct tactile feel. In an exemplary embodiment, this can be accomplished by arranging the printing module 31 to deposit a maximum mass laydown (M/A) of the non-marking particles 350 of at least 2 mg/cm$^2$. To enable development of a layer this thick, it has been found that the surface charge density ($\sigma_t$, units of μC/m$^2$) of the non-marking particles 350 should preferably be roughly a factor of 2× lower than the charge-to-mass ratio of the marking particles 355. In an exemplary embodiment, the surface charge density of the non-marking particles 350 is between 30% and 60% of the surface charge density of the marking particles 355. This has the effect of limiting the space charge voltage drop across this thick layer of toner, particularly when initially depositing the toner onto the photoreceptor. It can be shown that this voltage drop ($V_t$) varies as follows:

$$Vt = \frac{1}{2\varepsilon_O}(Q/M)(M/A)d \tag{2}$$

where $\epsilon_O$=8.854×10$^{-12}$ F/m is the free space permittivity, Q/M is the toner charge-to-mass ration, and d is the toner layer thickness. It is desirable to limit $V_t$ to enable the deposition of toner using reasonable electric fields of a magnitude of less than about 1 V/μm between the surface of the photoreceptor and the development subsystem, resulting in an upper limit for $V_t$ of roughly 500 V in magnitude. The requisite tactile feel determines the necessary mass laydown (M/A) and toner layer thickness (d), leaving toner charge-to-mass (Q/M) as the parameter that can be varied in order to achieve maximum coverage without an excessively high $V_t$. Typically the toner charge-to-mass (Q/M) depends on the toner size and surface charge density as follows:

$$Q/M = \frac{3\sigma_t}{\rho_t r} \tag{3}$$

where r is one-half of the volume average toner diameter, $\sigma_t$ is the surface charge density, and $\rho_t$ is the toner mass density (typically about 1.2 g/cm$^3$). The surface charge density is typically determined by a combination of charge control agents incorporated into the core toner formulation and surface treatment (sub-micron particles incorporated onto or into the toner surface).

As an example, a 6 μm volume average diameter surface treated toner may have a Q/M of 42 μC/g yielding a surface charge density of $\sigma_t$=50 μC/m$^2$. A larger-sized version of this toner, say 21 μm, having the same surface treatment, would have a Q/M of 12 μC/g. A mass laydown of 2 mg/cm$^2$ results in a $V_t$ of 470 V, within the upper limit described above. However, due to the problem of fusing a smaller-sized marking particle on top of a larger-sized non-marking particle, it is desirable to reduce the non-marking particle size from 21 μm to 11 μm. If the surface charging characteristics are held constant then the Q/M for the 11 μm toner will increase to 23 μC/g, resulting in a $V_t$ of 900 V for a laydown of 2 mg/cm$^2$, greatly exceeding the limit established above and therefore making it impractical to deposit such a thick layer of non-marking particles.

However, the surface charging characteristics of the 11 μm non-marking particles can be reduced by a factor of 2×, producing a lower surface charge density of $\sigma_t$=25 μC/m$^2$ (and hence a Q/M of 11.5 μC/g) and a lower $V_t$ of 450 V, falling within the desirable upper limit described above. This surface charge reduction may be accomplished by either altering the charge control agents or by altering the surface addenda (type or percent coverage) or by a combination of both methods. It should be recognized that other methods may be used to adjust the surface charge depending upon the development system. For example, for a two-component developer as described above, adjusting the toner concentration (ratio of toner to carrier particles) or changing properties of the carrier such as size, shape, surface coating or roughness may also be used to alter the toner surface charge. Or the rotational speed of components such as the mixing blades, rotating magnets or shell may be varied. For a single-component system using a donor roller or doctor blade, surface properties such as composition or roughness of the roller or blade may be controlled to alter the toner surface charge. Or the rotational speed of the donor roller or engagement of the doctor blade may be varied.

The remaining printing modules 32, 33, 34, 35 are used to apply layers of marking particles 355 over the layer of non-marking particles 350 in accordance with visible image data. In the illustrated embodiment, printing module 32 forms a layer of black marking particles according to a black color channel of the visible image data. Likewise, the printing modules 33, 34, 35 form layers of yellow, magenta and cyan marking particles, respectively, according to corresponding color channels of the visible image data.

The fuser module 60 is then used to fuse the layers of deposited non-marking particles 350 and marking particles 355 onto the receiver 42 to form the final printed tactile image 325 which includes a layer of fused non-marking particles 360, covered by layers of fused marking particles 365.

In a preferred embodiment, it is desirable that the volume average diameter of the marking particles 355 used to print the visible image data be in the range of 4-9 μm (or smaller) for image quality reasons It is well known that smaller-sized particles can enable better image quality, including lower granularity, higher sharpness, and finer resolution for tone scale.

To provide the desired tactile feel, it is desirable that the non-marking particles 350 be substantially larger than the marking particles 355. In a preferred embodiment, a volume average diameter of the non-marking particles 350 is at least 150% of a volume average diameter of the marking particles 355. However, inventors have discovered that undesirable effects are obtained if the non-marking particles 355 are too large. In particular, it has been found that when the layers of marking particles 355 are deposited over the layer of non-marking particles 350, if the relative size of the non-marking particles 355 is too large relative to the size of the marking particles 355, the marking particles 355 tend to seep into the voids between the non-marking particles 350 during the fusing process. This can result in a significant loss of color saturation. Inventors have discovered that this problem can be substantially mitigated by maintaining the volume average diameter of the non-marking particles 350 to be no more than about 200% of the volume average diameter of the marking particles 355. Even more preferably, the volume average diameter of the non-marking particles 350 is between about 160% and 190% of the volume average diameter of the marking particles 355.

In an exemplary embodiment, the marking particles 355 have a volume average diameter of approximately 6 μm, and the non-marking particles 355 have a volume average diameter of approximately 11 μm. The marking particles 355 are printed in layers that are approximately 6-8 μm thick before fusing, and are about 3-4 μm thick after fusing. This can be accomplished by depositing the marking particles 355 with a maximum coverage of about 0.35 mg/cm$^2$. The non-marking particles 350 are printed in layers that are approximately 35-40 μm thick before fusing, and are about 18-20 μm thick after fusing. This can be accomplished by depositing the non-marking particles 350 with a maximum coverage of about 2 mg/cm$^2$.

Figure 5:
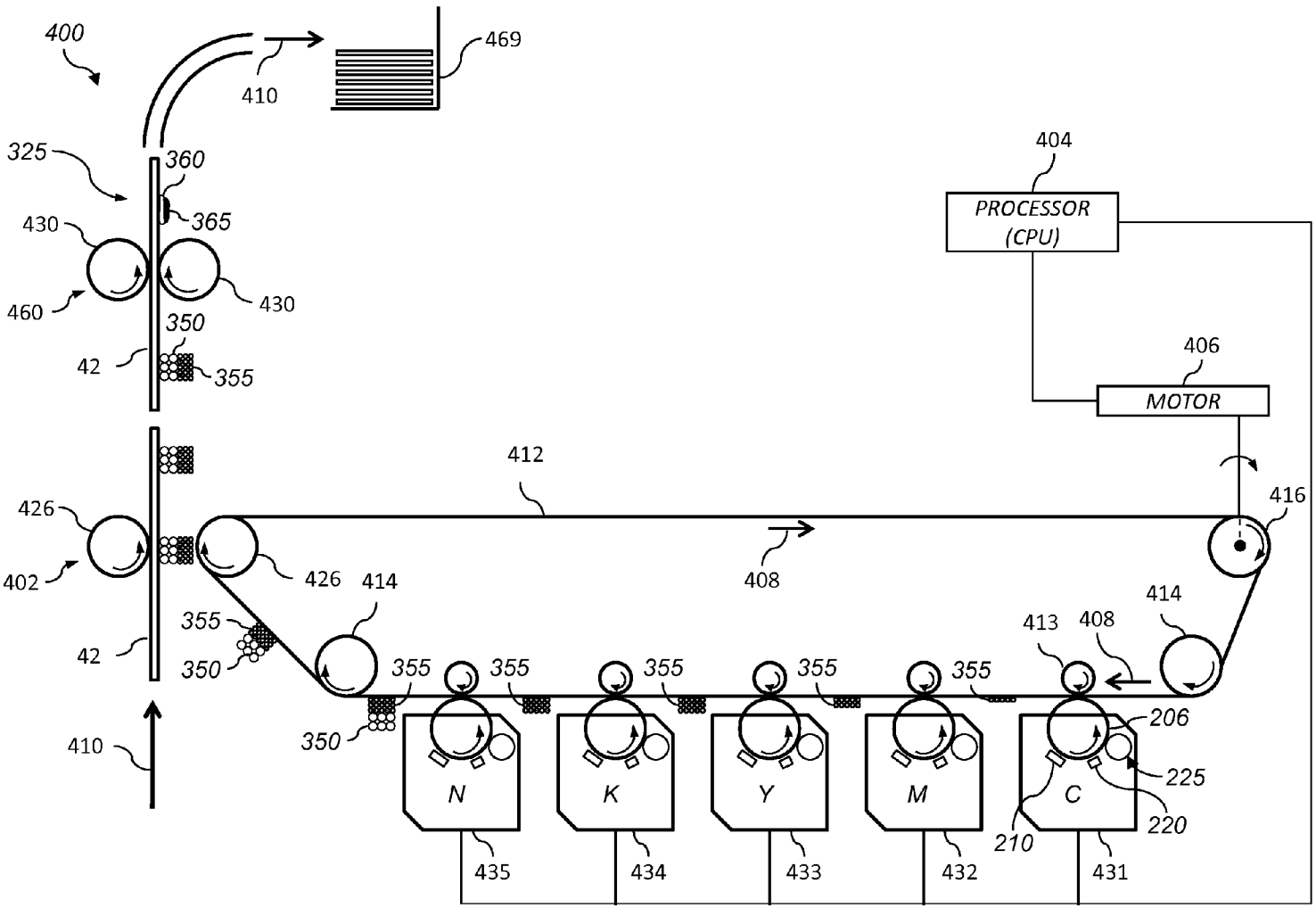
FIG. 5 is an elevational cross-section of an electrophotographic printer incorporating an intermediate transfer belt suitable for use with alternate embodiments.

The printer 100 illustrated in FIGS. 1 and 4 includes printing modules 31, 32, 33, 34, 35 that sequentially deposit layers of toner directly onto the receiver 42. In such configurations, each of the printing modules 31, 32, 33, 34, 35 typically includes its own intermediate transfer member 112 (FIG. 2). FIG. 5, illustrates an electrophotographic printer 400 in accordance with an alternate embodiment which incorporates an intermediate transfer member 412 in the form of a belt. In this configuration, a series of printing modules 431, 432, 433, 434, 435 are used to sequentially deposit layers of toner onto the intermediate transfer member 412. The deposited layers of toner are then transferred from the intermediate transfer member 412 to a sheet of receiver 42 at a transfer station 402, and are then fused to the receiver 42 at a subsequent fuser module 460. A processor 404 is used to control the printing modules 431, 432, 433, 434, 435 and other components of the printer 400.

The printing modules 431, 432, 433, 434, 435 are similar to the printing module 31 illustrated in FIG. 2, except that they do not include the intermediate transfer member 112. As such, they each include a photoreceptor 206 for storing electrostatic charge, a charging subsystem 210 for depositing uniform electrostatic charge on the surface of the photoreceptor 206, a light exposure subsystem 220 for making an electrostatic latent image on the photoreceptor 206 in an imagewise fashion, and a development subsystem 225 for depositing toner onto the electrostatic latent image. The photoreceptor 206 for each of the printing modules 431, 432, 433, 434, 435 is in nipped contact with the intermediate transfer member 412 via a backup roller 413 for electrostatically transferring the toner from the photoreceptor 206 to the intermediate transfer member 412.

Preferably, the intermediate transfer member 412 includes at least one compliant layer. As is described in commonly-assigned U.S. Pat. No. 8,475,926 to Ferrar et al., entitled "Intermediate transfer member and imaging apparatus and method," which is incorporated herein by reference, the intermediate transfer member 412 in an electrophotographic process typically includes a substrate upon which one or more layers are disposed. The substrate can be in the form of a roller (drum) or an endless belt (seamless and jointed belts). The presence of a compliant layer that is soft generally aids in the complete transfer of toner. For example, the compliant layer can be a soft layer that helps prevent hollow character and improve transfer uniformity when toner is transferred onto a rough receiver 42. Urethane polymers are often used as compliant layers because they can be both soft, with a low durometer, and tough, with high tear strength. Representative roller substrates are described for example in commonly-assigned U.S. Pat. No. 5,968,656 to Ezenyilimba et al, entitled "Electrostatographic intermediate transfer member having a ceramer-containing surface layer," which is incorporated herein by reference. A roller can have a polyurethane compliant layer on a rigid material such as an aluminum cylinder.

Suitable substrates for intermediate transfer belts 412 are often formed from a partially conductive or static dissipative thermoplastic such as polycarbonates and polyimides filled with carbon or a conductive polymer such as a polyaniline or polythiophene. While not necessary, a primer layer can be coated onto the substrate before a compliant layer is applied, or in place of the compliant layer.

Other useful belt substrate compositions include polyamideimides, fluorinated resins such as poly(vinylidene fluoride) and poly(ethylene-co-tetrafluoroethylene), vinyl chloride-vinyl acetate copolymers, ABS resins, and poly(butylene or terephthalate). Mixtures of the noted resins can also be used. These resins can also be blended with elastic materials and can also include other additives including antistatic agents. The belt or roller can be formulated to have a desired Young's modulus and other properties for a given apparatus and toner transfer process. Typically, an intermediate transfer member 412 that is in the form of a belt will have an average total thickness of at least 75 μm and up to and including 1000 μm. Such belts can have, for example, a length of at least 50 cm and up to and including 500 cm.

A nanoparticle-containing ceramer or fluoroceramer composition is applied to a relatively soft polyurethane compliant layer. The chemical compatibility between the two compositions provides good adhesion of the two layers. In such embodiments, a primer layer is generally not needed. The relatively harder surface layer does not display a tendency to crack that is usually observed when a hard composition is disposed on a softer layer. Thus, the composition used in the present invention, with its high Young's modulus (>100 MPa) can be disposed on the low Young's modulus (<50 MPa) compliant layer. This is particularly useful for preparing flexible intermediate transfer members with good toner release characteristics.

The non-ceramer polyurethane compliant layer disposed on the substrate provides some flexibility to the intermediate transfer member 412 to conform to the irregularities encountered during electrostatic toner transfer. Typically, this polyurethane is elastomeric and has a Young's modulus of from about 0.5 MPa to about 50 MPa, or more likely from about 1 MPa to about 5 MPa. This compliant layer generally has an average thickness of at least 100 μm and more likely at least 200 μm and up to and including 1000 μm.

In an exemplary embodiment, an outermost surface layer (also known as an "overcoat") consisting essentially of a non-particulate, non-fluorinated ceramer or fluoroceramer and nanosized inorganic particles is directly disposed on the polyurethane compliant layer. Thus, this outermost surface layer contains no other needed components for toner transfer and any additives (such as antioxidants, colorants, or lubricants) are optional. The outermost surface layer is generally transparent and has an average thickness, in dry form, of at least 1 μm and up to and including 20 μm, or typically at least 2 and up to and including 12 μm, or even at least 5 μm and up to 12 μm. The thickness ratio of the outermost surface layer to the intermediate non-ceramer polyurethane compliant layer is at least 0.002:1 and up to and including 0.1:1.

The outermost surface layer generally has a Young's modulus that is much higher than that of the compliant layer, and thus, its Young's modulus is at least 50 MPa and up to and including 2000 MPa. This Young's modulus does not appear to be affected by the presence of the nanosized inorganic particles. Surprisingly, ceramers and fluoroceramers having high amounts of alkoxysilane crosslinker and high amounts of nanosized inorganic particles do not readily crack. For example, fluoroceramer coatings prepared with tetraalkoxysilane as the crosslinker and nanosized fumed silica (about 30 weight %) dispersed therein did not crack after more than 5000 prints were prepared on an electrophotographic printing apparatus.

The outermost surface layer has a measured storage modulus of at least 0.1 and up to and including 2 GPa, or typically at least 0.3 GPa and up to and including 1.75 GPa, or still again at least 0.5 GPa and up to and including 1.5 GPa, when measured using a Dynamic Mechanical Analyzer (DMA).

In addition, the outermost surface layer has a dynamic (kinetic) coefficient of friction of less than 0.5 or typically less than 0.2. Furthermore, the outermost surface layer generally has an average surface roughness Ra of less than 50 nm, as measured by Atomic Force Microscopy (AFM).

The processor 404 provides necessary electrical signals to operate the printing modules 431, 432, 433, 434, 435, and a motor 406. The motor 406 turns a drive roller 416 to drive the intermediate transfer member 412 around a belt path 408, which typically includes other rollers 414. The motor 406 also drives a pair of nipped transfer rollers 426, and a pair of nipped fuser rollers 430.

The receiver 42 moves along a sheet path 410 which passes between the nipped transfer rollers 26, where toner is transferred from the intermediate transfer member 412 to the receiver 42. The sheet path 410 then passes between the nipped fuser rollers 430 where the heat and pressure is applied to fuse the toner to the receiver 42. The receiver 42 including the printed image is then stacked in an output tray 469.

In accordance with embodiments of the present invention, printing modules 431, 432, 433, 434 are used to apply layers of marking particles 355 onto the intermediate transfer member 412 in accordance with visible image data. In the illustrated embodiment, printing module 431 forms a layer of cyan marking particles according to a cyan color channel of the visible image data. Likewise, the printing modules 432, 433, 434 form layers of magenta, yellow and black marking particles, respectively, according to corresponding color channels of the visible image data.

The last printing module 435 is then used to form a layer of non-marking particles 350 over the layers of marking particles 355. The layer of non-marking particles 350 is patterned according to tactile image data which defines a pattern of raised information to be formed on the printed image.

The layers of marking particles 355 and non-marking particles 350 are then transferred to the receiver 42 at the transfer station 402. In an exemplary embodiment, the marking particles 355 and non-marking particles 350 are negatively charged, and an electric field is applied between the transfer rollers 426 to transfer the marking particles 355 and non-marking particles 350 are then transferred to the receiver 42. Since the non-marking particles 350 are printed last, they will be on top layer before they are transferred, and will therefore be the bottom layer after they are transferred to the receiver medium 42. The non-marking particles 350 will therefore be in direct contact with the receiver medium 42.

The fuser module 460 is then used to apply heat and pressure to fuse the layers of deposited non-marking particles 350 and marking particles 355 onto the receiver 42 to form the final printed tactile image 325 which includes a layer of fused non-marking particles 360, covered by layers of fused marking particles 365.

Figure 6:
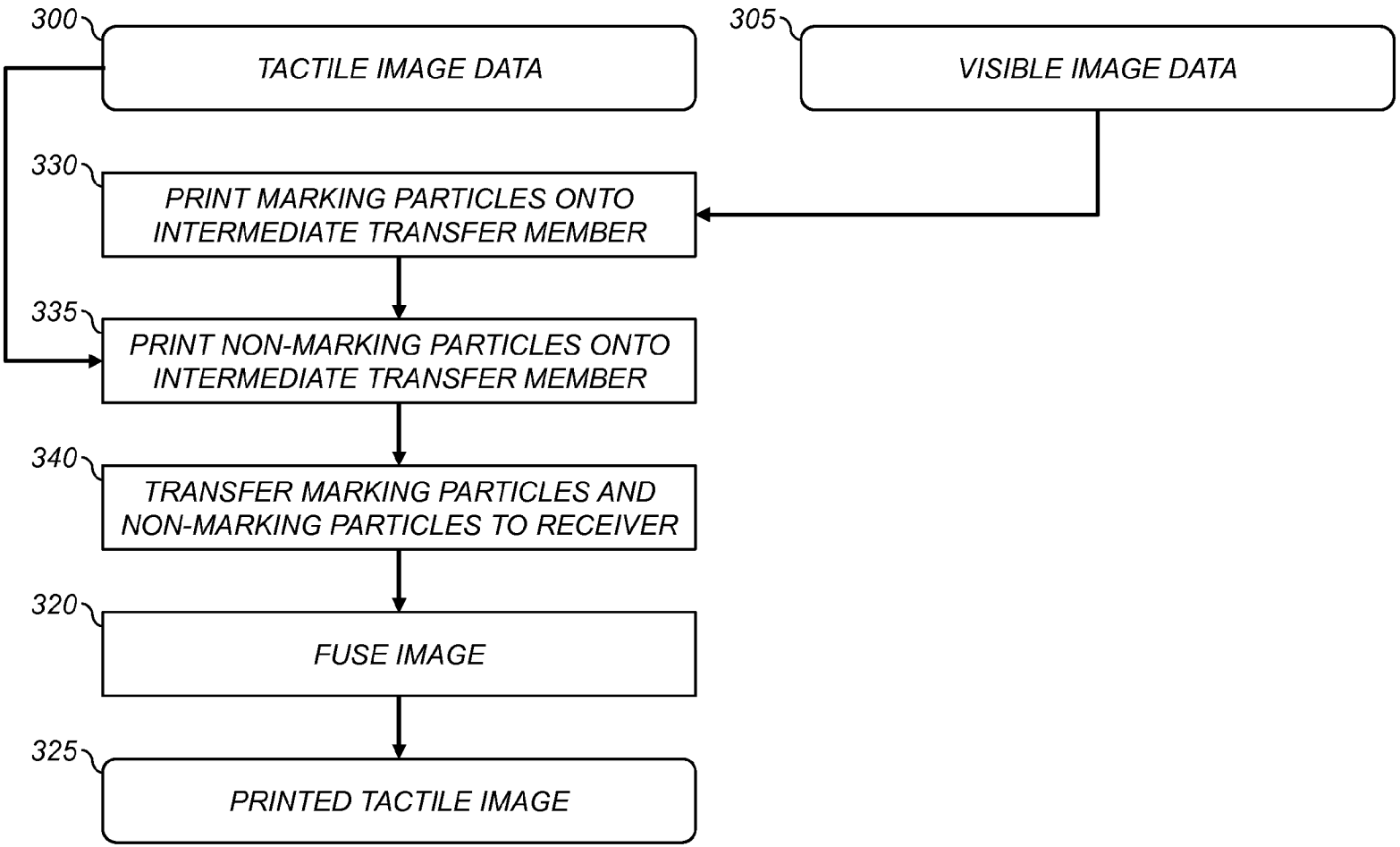
FIG. 6 is a flowchart of a method for producing a printed tactile image using the electrophotographic printer of FIG. 5 according to an exemplary embodiment.

FIG. 6 shows a flow chart summarizing a method for forming printed images having a distinct tactile feel in accordance with an exemplary embodiment which uses printer 400 of FIG. 5. The illustrated method is similar to that described earlier with respect to FIG. 3 except for features which relate to the use of the intermediate transfer member 412 (FIG. 5). The input to the method is tactile image data 300 defining a pattern of raised information to be printed together with visible image data 305 defining a conventional visible image.

A print marking particles onto intermediate transfer member step 330 is used to form a pattern of visible marking particles 355 (i.e., pigmented toner particles) on the surface of the intermediate transfer member 412 (FIG. 5) using an electrophotographic process responsive to the visible image data 305. The marking particles 355 are formed in one or more layers. In an exemplary embodiment, each layer of marking particles 355 has a different color and is applied by a corresponding printing module 431, 432, 433, 434 of the printer 400 (FIG. 5).

A print non-marking particles onto intermediate transfer member step 335 is then used to form a pattern of non-marking particles 350 (i.e., non-pigmented toner particles) on the surface of the intermediate transfer member 412 (FIG. 5) over the one or more layers of marking particles 355 using the printing module 435 (FIG. 5) responsive to the tactile image data 300. Note that the term "over" in this context is not intended to imply higher or lower in a vertical direction, but rather implies that the marking particles 355 are between the non-marking particles 350 and the intermediate transfer member 412. For example, in FIG. 5, immediately following the printing module 435, the non-marking particles 350 are actually below the marking particles 355 in a vertical direction, even though the non-marking particles 350 are applied "over" the marking particles 355. As discussed earlier, the non-marking particles 350 preferably do not contain any pigment so that they will be substantially colorless or transparent after they have been fused to the receiver 42.

After the layers of marking particles 355 (FIG. 5) and non-marking particles 350 (FIG. 5) have been formed onto the intermediate transfer member 412 (FIG. 5), a transfer marking particles and non-marking particles to receiver step 340 is used to transfer the non-marking particles 350 and the marking particles 355 to the receiver 42 (FIG. 5). After the transfer, the non-marking particles 350 will be in direct contact with the receiver 42.

After the non-marking particles 350 and the marking particles 355 have been transferred onto the receiver medium, fuse image step 320 is used to fuse the image, permanently affixing the toner particles to the receiver medium 42 (FIG. 5), thereby forming the final printed tactile image 325. In an exemplary embodiment, the toner particles are fused using the fuser module 460 (FIG. 5) of printer 400 (FIG. 5).

The invention has been described in detail with particular reference to certain preferred embodiments thereof, but it will be understood that variations and modifications can be effected within the spirit and scope of the invention.

PARTS LIST

31 printing module
32 printing module
33 printing module
34 printing module
35 printing module
38 print image
39 fused image
40 supply unit
42 receiver
42*a* receiver
42*b* receiver
50 transfer subsystem
60 fuser module
62 fusing roller
64 pressure roller
66 fusing nip
68 release fluid application substation
69 output tray
70 finisher
81 transport web
86 cleaning station
99 logic and control unit
100 printer
111 imaging member
112 intermediate transfer member
113 transfer backup member
201 first transfer nip
202 second transfer nip
206 photoreceptor
210 charging subsystem
211 meter
212 meter
213 grid
216 surface
220 exposure subsystem
225 development subsystem
226 toning shell
227 magnetic core
240 power source
300 tactile image data
305 visible image data
310 print non-marking particles onto receiver step
315 print marking particles onto receiver step
320 fuse image step
325 printed tactile image
330 print marking particles onto intermediate transfer member step
335 print non-marking particles onto intermediate transfer member step
340 transfer marking particles and non-marking particles to receiver step
350 non-marking particles
355 marking particles
360 fused non-marking particles
365 fused marking particles
400 printer
402 transfer station
404 processor
406 motor
408 belt path
410 sheet path
412 intermediate transfer member
413 backup roller
414 roller
416 drive roller
426 transfer rollers
430 fuser rollers
431 printing module
432 printing module

433 printing module
434 printing module
435 printing module
460 fuser module
469 output tray

The invention claimed is:

1. A method of forming an electrophotographic image on a receiver medium having raised information providing a distinct tactile feel, comprising:

forming a layer of non-marking particles onto the receiver medium using an electrophotographic process responsive to tactile image data, wherein the layer of non-marking particles is in direct contact with the receiver medium;

forming one or more layers of marking particles over the layer of non-marking particles using an electrophotographic process responsive to visible image data, wherein a volume average diameter of the non-marking particles is at least 150% of a volume average diameter of the marking particles and is no more than 200% of the volume average diameter of the marking particles; and fusing the formed layers of non-marking particles and marking particles onto the receiver medium, wherein the layer of fused non-marking particles has a maximum thickness of at least 20 μm to provide the distinct tactile feel;

wherein a surface charge density of the non-marking particles is between 30% and 60% of a surface charge density of the marking particles.

2. The method of claim 1 wherein the volume average diameter of the marking particles is between 4-9 μm.

3. The method of claim 1 wherein the layer of non-marking particles has a maximum coverage of at least 2 $mg/cm^2$.

4. The method of claim 1 wherein the volume average diameter of the non-marking particles is at least 160% of the volume average diameter of the marking particles and is no more than 190% of the volume average diameter of the marking particles.

5. The method of claim 1 wherein the raised information is used to form Braille characters that can be sensed by visually-impaired persons.

* * * * *